US007798920B1

(12) United States Patent
Cortes

(10) Patent No.: US 7,798,920 B1
(45) Date of Patent: Sep. 21, 2010

(54) SPORTING ACTIVITY SYSTEM

(76) Inventor: Dagoberto S. Cortes, 520 Butternut Dr., Suite 80-233, Holland, MI (US) 49424

( * ) Notice: Subject to any disclaimer, the term of this patent is extended or adjusted under 35 U.S.C. 154(b) by 610 days.

(21) Appl. No.: 11/249,024

(22) Filed: Oct. 12, 2005

Related U.S. Application Data

(60) Provisional application No. 60/619,666, filed on Oct. 18, 2004.

(51) Int. Cl.
*A63B 69/00* (2006.01)

(52) U.S. Cl. ..... 473/440; 482/14; 482/15; 482/51; 434/427; 434/251; 434/255; 52/677; 52/686; 52/296

(58) Field of Classification Search ..... 52/296, 52/677, 65.14, 687, 297, 684, 685, 686, 688, 52/689; 403/362, 236; 434/247, 251, 255; 482/14, 15, 51; 446/118, 120, 121, 124; 473/440
See application file for complete search history.

(56) References Cited

U.S. PATENT DOCUMENTS

| | | | | | |
|---|---|---|---|---|---|
| 2,537 | A * | 4/1842 | Harvey | 403/236 |
| 415,065 | A * | 11/1889 | Rung | 248/413 |
| 3,086,270 | A * | 4/1963 | Zartler | 24/278 |
| 5,107,654 | A * | 4/1992 | Leonardis | 52/685 |
| 5,729,949 | A * | 3/1998 | Hartzheim | 52/677 |
| 5,803,660 | A * | 9/1998 | Warren et al. | 405/25 |
| 6,279,274 | B1 * | 8/2001 | Amiet et al. | 52/125.2 |
| 6,345,474 | B1 * | 2/2002 | Triplett | 52/169.9 |
| 2003/0084544 | A1 * | 5/2003 | Newman et al. | 16/427 |
| 2004/0159280 | A1 * | 8/2004 | Mohelsky et al. | 116/63 C |
| 2006/0229171 | A1 * | 10/2006 | Severino | 482/93 |

OTHER PUBLICATIONS http://web.archive.org/web/20040804111330/www.outdoorfunstore.com/sports/agility5.asp.*
Coaching Equipment catalog pages from Reedswain.com pp. 55-61, dated 2005.

* cited by examiner

*Primary Examiner*—Richard E Chilcot, Jr.
*Assistant Examiner*—Anthony N Bartosik
(74) *Attorney, Agent, or Firm*—Jovan N. Jovanovic; Vladan M. Vasiljevic; The Watson I.P. Group, PLC

(57) ABSTRACT

A sporting activity system comprising a plurality of stakes and a plurality of pods. The plurality of stakes each have a length and a cross-sectional configuration. Each pod includes a body and a member for interfacing with a stake. The body includes a lower edge, a side and a top surface. The interfacing member includes an opening disposed on one of the top and the sides configured to receive a stake, and, two channels disposed on the body spaced apart from the opening. Each of the at least two channels and the opening can accept a stake of the plurality of stakes simultaneously. Connectors may be provided releasably coupling two stakes of the plurality of stakes to each other.

15 Claims, 6 Drawing Sheets

SPORTING ACTIVITY SYSTEM

CROSS-REFERENCE TO RELATED APPLICATION

This application claims priority from U.S. Provisional Patent Application Ser. No. 60/619,666 entitled "Sporting Activity Apparatus" filed Oct. 18, 2004, the entire specification of which is incorporated by reference.

BACKGROUND OF THE INVENTION

1. Field of the Invention

The present invention relates in general to sporting equipment, and more particularly, to a series of obstacles and devices to promote exercise and sporting practice.

2. Background Art

It has long been known to use cones and other obstacles during training and exercise for sporting events. For example, many sports utilize old tires, cones, and/or barricades as training aids. Old tires are often positioned on the ground and athletes are instructed to alternatively run through rows of tires placing feet in and out of the center opening of each tire.

Other devices comprise sticks that can be positioned into the ground as stakes or between objects as elevated members. The stakes can be used as obstacles. For example, the stakes can be positioned such that athletes can dribble a soccer ball around the stakes to practice precision kicking, dribbling and control. Finally, cones are often utilized for similar purposes.

Among other problems, many of these solutions are quite expensive. Other solutions are usable only outside, and have little utility on indoor fields. Still other solutions have little versatility and are adaptable for only a few different uses.

Thus, it is an object of the present invention to overcome the deficiencies of the prior art.

This and other objects will become apparent in light of the specification and claims appended hereto.

SUMMARY OF THE INVENTION

The invention comprises a sporting activity system. The activity system includes a plurality of stakes and a plurality of pods. Each stake has a length and a cross-sectional configuration. Each pod includes a body and means for interfacing with a stake. The body includes a lower edge adapted to position on an outer surface, a side extending from the lower edge and a top surface terminating the side. The interfacing means comprises an opening disposed on one of the top and the sides and at least two channels disposed on the body. The opening is configured to receive a stake of the plurality of stakes and the at least two channels are spaced apart from the opening such that each of the at least two channels and the opening can accept stakes simultaneously.

In a preferred embodiment, the system further comprises at least one connector for associating a first stake to a second stake spaced apart from any one of the plurality of pods.

In one such preferred embodiment, the at least one connector has a first stake retaining assembly and a second stake retaining assembly. The first and second stake retaining assemblies of the at least one connector are configured such that a stake inserted into the first stake retaining assembly and a stake inserted into the second stake retaining assembly will be substantially orthogonal to each other.

In another embodiment, the at least one connector includes a ring member and a threaded suspending member, the threaded suspending member threadable into a threaded opening in the ring member, wherein the threaded suspending member in cooperation with the ring member retains a stake therebetween, and a second stake member is suspended about the threaded suspending member outside of the ring member.

In yet another embodiment, the at least two channels each include a longitudinal axis wherein the longitudinal axes intersect each other.

Preferably, the at least two channels comprise two pairs of channels. The first pair extends substantially parallel to each other and on opposite sides of the opening. The second pair extends substantially parallel to each other. The first pair and the second pair are substantially orthogonal to each other.

In a preferred embodiment, the body of the plurality of pods comprises a frustoconical configuration, with the opening extending through the center of the top surface. The opening may include a skirt member depending from the top surface of the body. A portion of the skirt member has a region of a relatively reduced diameter.

In a preferred embodiment, the at least two channels have a depth that is greater than the diameter of the at least one of the plurality of stakes.

In another preferred embodiment, a plane is defined by the lower edge of the body. Additionally, longitudinal axes are defined by the at least two channels. The longitudinal axes of the at least two channels are each substantially parallel to the plane defined by the lower edge of the body.

In a preferred embodiment, the top surface of the body is substantially parallel to the lower edge of the body.

In another aspect of the invention, the invention comprises a pod for use in association with a sporting activity system having a plurality of stakes. Each pod includes a body and means for interfacing with a stake. The body includes a lower edge adapted to position on an outer surface, a side extending from the lower edge and a top surface terminating the side. The interfacing means comprises an opening disposed on one of the top and the sides and at least two channels disposed on the body. The opening is configured to receive a stake of the plurality of stakes and the at least two channels are spaced apart from the opening such that each of the at least two channels and the opening can accept stakes simultaneously.

BRIEF DESCRIPTION OF THE DRAWINGS

The invention will now be described with reference to the drawings wherein.

DETAILED DESCRIPTION OF THE INVENTION

Figure 1:
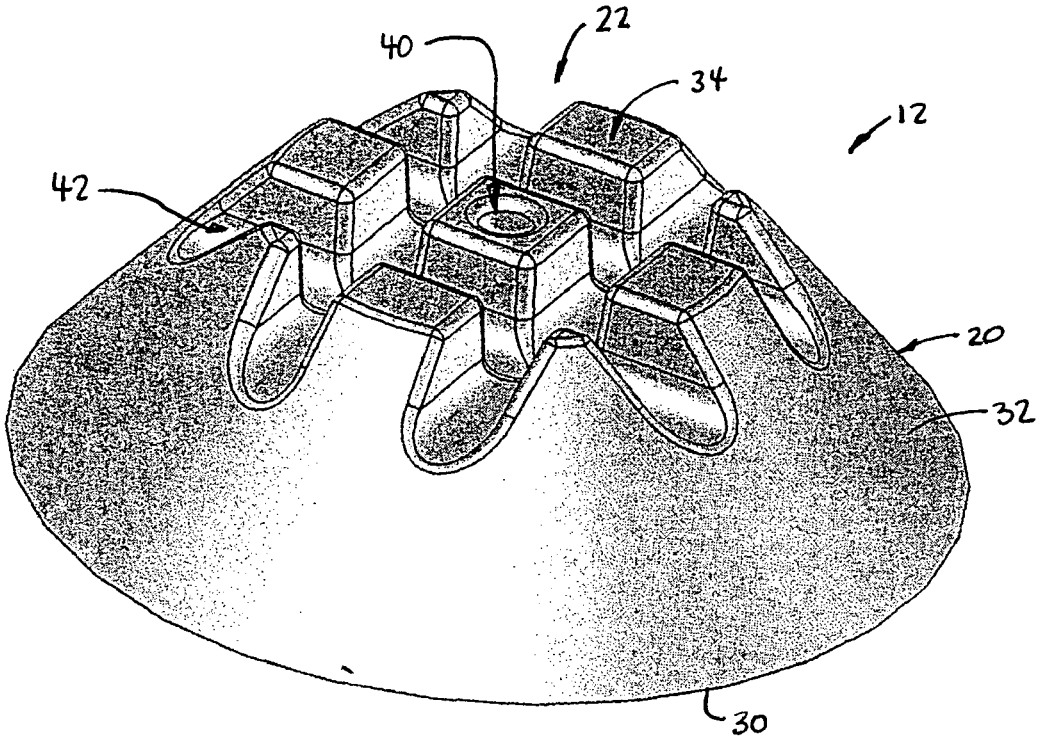
FIG. 1 of the drawings comprises a perspective view of a pod of the system of the present invention.

While this invention is susceptible of embodiment in many different forms, there is shown in the drawings several specific embodiments with the understanding that the present disclosure is to be considered as an exemplification of the principles of the invention and is not intended to limit the invention to the embodiments illustrated.

It will be understood that like or analogous elements and/or components, referred to herein, are identified throughout the drawings by like reference characters. In addition, it will be understood that the drawings are merely representations of the present invention, and some of the components may have been distorted from actual scale for purposes of pictorial clarity.

Figure 6:
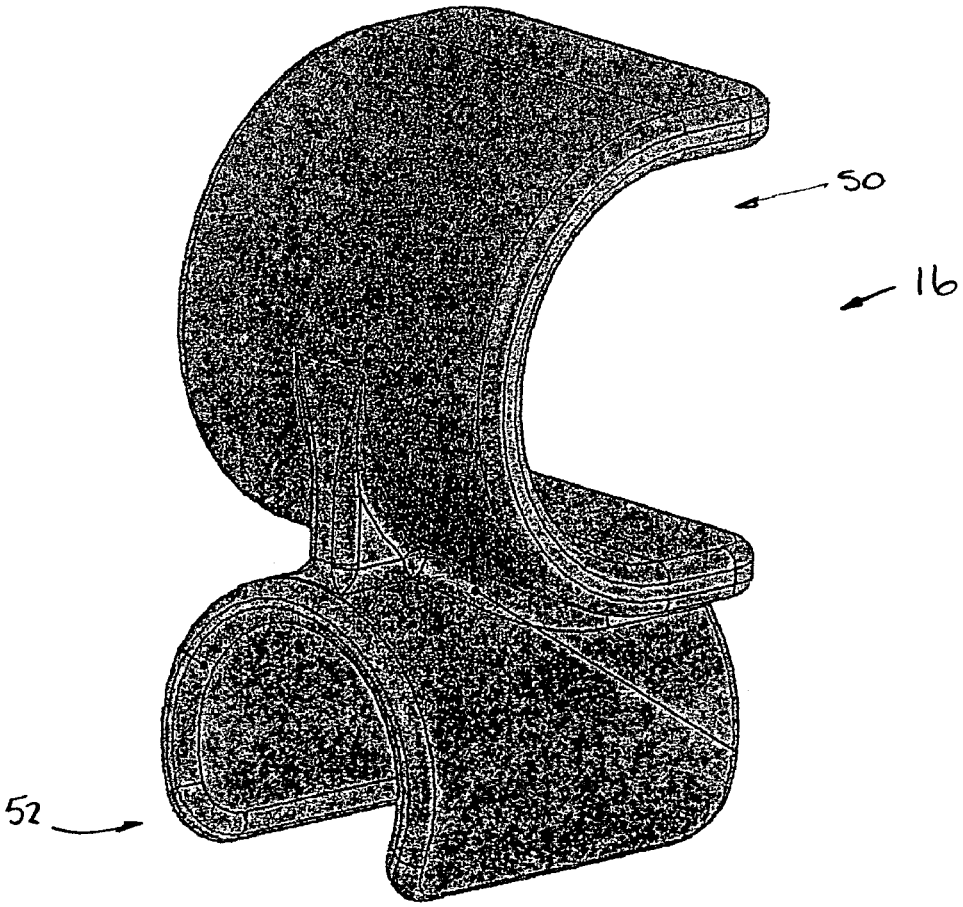
FIG. 6 of the drawings comprises a perspective view of a connector of the system of the present invention.
Figure 8:
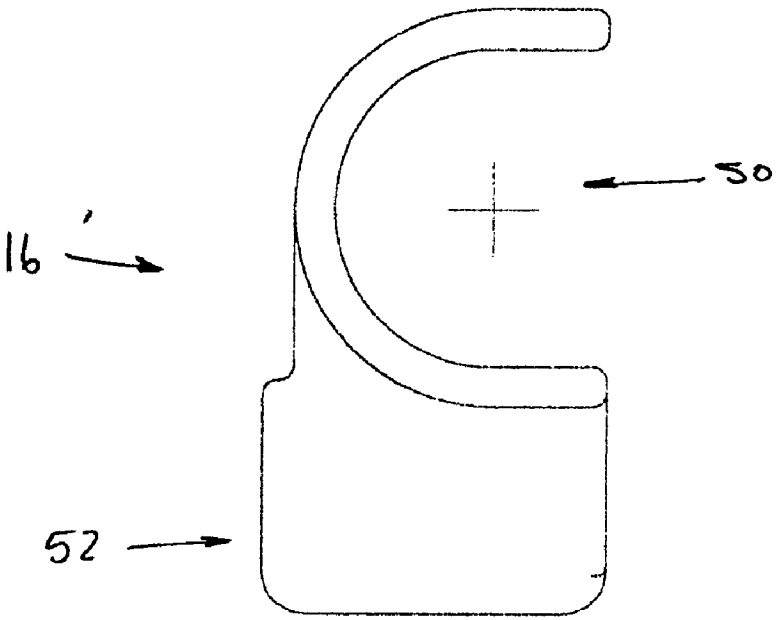
FIG. 8 of the drawings comprises a side elevational view of a connector of the system of the present invention.
Figure 7:
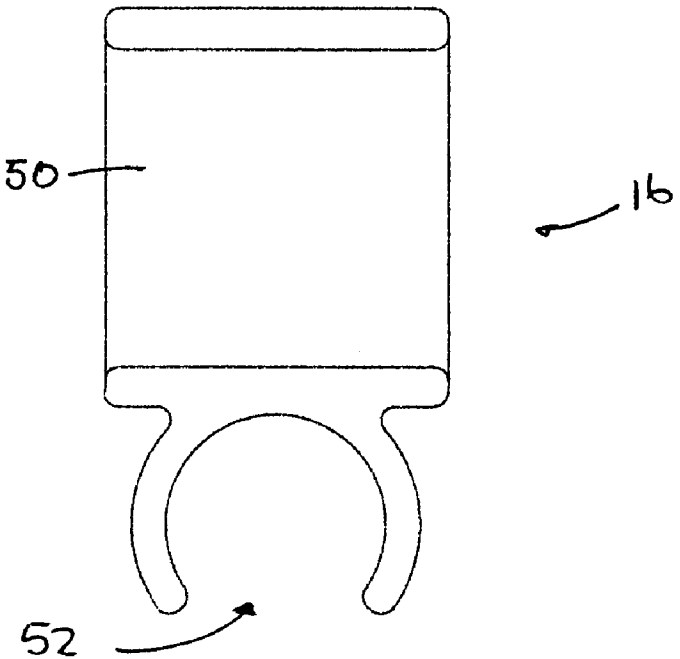
FIG. 7 of the drawings comprises a side elevational view of a connector of the system of the present invention.

Referring now to the Figures, and in particular to FIG. 9(*b*), sporting activity system is shown generally at 10. The sporting activity apparatus comprises a plurality of pods, such a pod 12 (FIG. 1), stakes 14 (FIGS. 9(*a*) through 9(*d*)) and connectors 16 (FIG. 6). It is contemplated that a set may be formed from twelve pods, twenty stakes and a number of connectors. Of course, any number of different combinations of the pods, stakes and connectors are contemplated for use. A number of different configurations are shown in FIGS. 9(*a*) through 9(*d*) and will be described in detail below.

Figure 3:
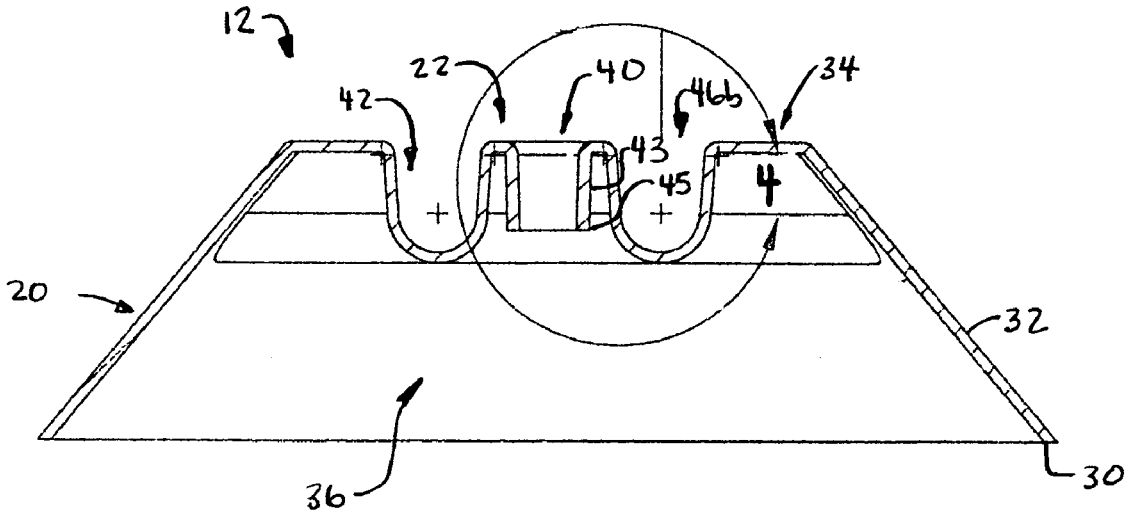
FIG. 3 of the drawings comprises a cross-sectional view of a pod of the system of the present invention taken generally about lines 3-3 of FIG. 2.

Pod 12 is shown in FIGS. 1 and 3 as comprising body 20 and means 22 for interfacing with stakes, such as stake 14 of FIG. 9(*b*). Body 20 includes lower edge 30, side 32 and top surface 34. The lower edge 30 defines a plane, as does top surface 34. While the invention is not limited to any particular size for the pod, in a preferred embodiment, the lower edge of the pod has a diameter of approximately 9.75" and top surface is spaced about 2.875" from the lower edge. Preferably, the planes created by each of the lower edge and the top surface are substantially parallel to each other.

Figure 5:
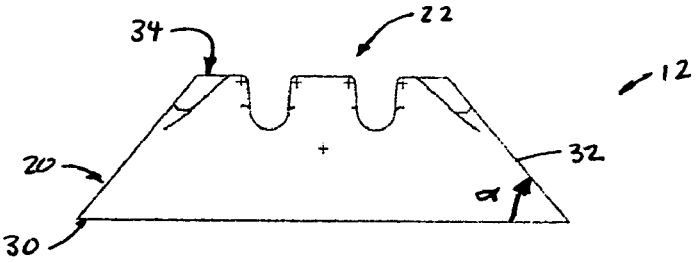
FIG. 5 of the drawings comprises a side elevational view of a pod of the system of the present invention.

With reference to FIG. 5, the side renders a substantially frustoconical configuration. The angle ($\alpha$) at which the side is inclined can be varied; in the embodiment shown, the side is angled at approximately 50.25°. Of course, the invention is not limited thereto, and this angle can be varied. In certain embodiments, the shape may be cylindrical, however, it will be understood that a frustoconical configuration yields greater stability. As is shown in FIG. 3, the side is relatively thin (i.e., 0.100"), thus, the side and the top surface substantially define cavity 36. It is contemplated that pod 12 comprises a molded polymer material that can be fabricated in any number of different methods. Of course, other materials such as composites, metals, wood, among others, are likewise contemplated.

With reference to FIG. 1, stake interfacing means 22 comprises at least one opening 40 extending into body 20 of pod 12 and a plurality of channels, such as channels 42, disposed on body 20 of pod 12. The stake interfacing means provides multiple different structures for accepting and retaining the stakes in a number of different configurations. In the embodiment shown, and with reference to FIGS. 3 and 4, opening 40 is disposed in the center of top surface 34 and includes downwardly extending skirt 43 which extends into cavity 36 and terminates at lower end 45. The lower end 45 includes a diameter which is smaller than that of the top end of the skirt. The larger upper end diameter facilitates ease of insertion of the stake into the opening, while the narrower lower end improves retention of the stake within the opening. In certain embodiments, multiple openings can be positioned about either the top surface or the side of the pod. Advantageously, by placing the opening proximate the center of the top surface, the stake is naturally positioned in such a way as to maximize the stability of the pod.

Figure 2:
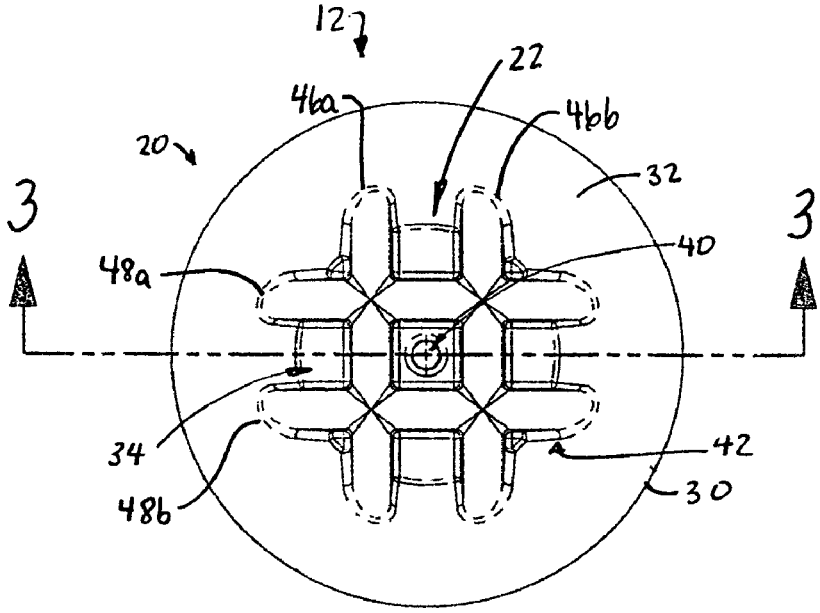
FIG. 2 of the drawings comprises a top plan view of a pod of the system of the present invention.

With reference to FIG. 2, the plurality of channels 42 include a first set of channels 46*a*, 46*b* which are positioned below top surface 34 and extend along opposing sides of opening 40, and a second set of channels 48*a*, 48*b* which likewise are positioned below top surface 34 and extend along opposing sides of opening 40. In the embodiment shown, each channel in the first set of channels 46*a*, 46*b* is parallel to each other. Each channel in the second set of channels 48*a*, 48*b* is parallel to each other. The first set of channels and the second set of channels are substantially orthogonal to each other. As such, a double cross pattern is established dividing the top surface into 9 separate areas or regions (FIG. 1). By positioning the channels 42 on opposing sides of the opening, both the channels and the openings can be utilized at the same time. Moreover, by providing multiple channels 42 in the parallel and orthogonal configuration, the options for positioning stakes, such as stakes 14, greatly increases. It will be understood that a greater or fewer number of channels 42 may be utilized. For example, additional channels (in excess of four) may be provided along the sides or on either side of existing channels 42, thereby providing more options to the user. In other embodiments, two or three channels 42 may be provided instead of the four shown. Moreover, the channels may be positioned such that they are parallel, orthogonal or otherwise oblique to each other.

Figure 4:
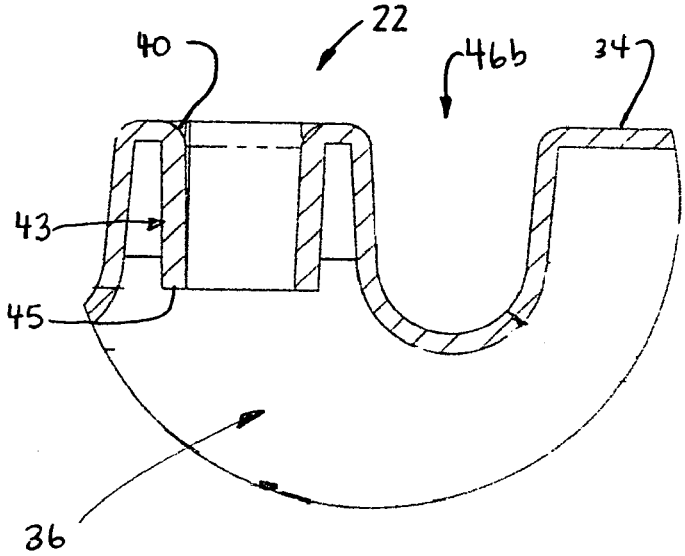
FIG. 4 of the drawings comprises a detailed cross-sectional view of a portion of a pod of the system of the present invention, taken generally about circle marked 4 of FIG. 3.

As is shown in FIGS. 3 and 4 with respect to channel 46*b*, the channels comprise substantially u-shaped members which each have a longitudinal axis defined thereby. The longitudinal axes are, preferably, each parallel to the plane created by the lower edge of body 20 of pod 12. Preferably, each of the channels 42 has a substantially similar depth, and inasmuch as they are evenly spaced, each is of a substantially equal length. In the embodiment contemplated, the channels have a width which is slightly larger than the stakes 14 used therewith, and depth which is preferably greater the diameter of the stakes 14 used therewith. It is preferred that the depth of the channels 42 is such that two stakes, such as stakes 14, can be stacked (or crossed) while being retained by the channels 42 (i.e., the depth of the channel is, for example, 1.5 times that of the diameter of the stake). The upper end of each channel 42 has a slightly widened opening to facilitate the receipt of stakes 14.

Stake 14 is shown in FIGS. 9(*a*) through 9(*d*) as comprising an elongated bar member which has a diameter, a portion of which is less than that of the channels or the opening. In the embodiment shown, the stake comprises a circular cross-sectional member which is substantially uniform and which has a diameter which is less than approximately 0.575". In other embodiments, the stakes may have a square, rectangular, elliptical, octagonal, arbitrary or other cross-sectional configuration. Additionally, the stakes may be non-uniform in configuration. The stakes generally comprise a hollowed out polymer rod member. In other embodiments, the stakes may comprise composites, metals or other members. Furthermore, a number of different stakes of differing diameters can be provided.

It will be understood that the stakes may comprise a number of different lengths, such as, for example, two, three, and four foot sections. Of course, the invention is not limited to any particular length. In still other embodiments, the stakes may be telescopic or otherwise collapsible member which can be articulated when necessary. In still other embodiments, multiple stakes may be attachable to each other so as to facilitate the use of stakes of different sizes.

Connector 16 is shown in FIG. 1 as comprising first stake retaining assembly 50 and second stake retaining assembly 52. The first and second stake retaining assemblies each comprise a resilient member configured so as to include an inner surface which substantially conforms to the shape of stake. Preferably, the inner surface is slightly smaller than the stake such that upon insertion, the resilience of the material places a biasing force upon the stake member, thereby retaining it in the attached configuration. In other embodiments, the outer edges of the inner surface may include a bump or other ridge. Upon insertion of the stake, the stake forces the opposing bumps outwardly thereby permitting the stake to pass therebetween and to be captured by the inner surface of the retaining assembly. Most preferably, the connector comprises a polymer material which has the required resilience. In other embodiments, the connector may comprise a metal member or a composite member.

Figure 9A:
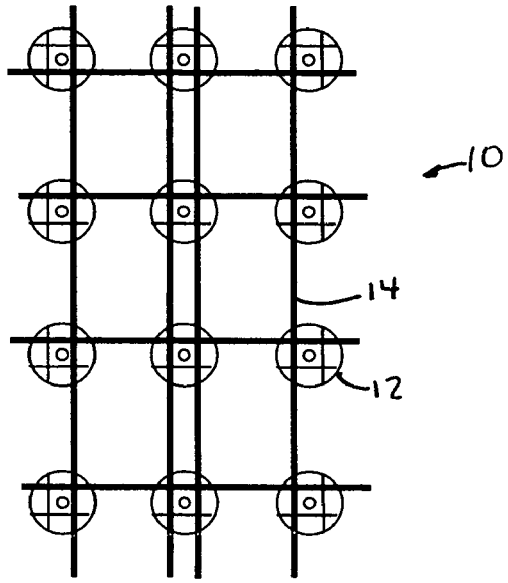
FIGS. 9(*a*) through 9(*d*) show various manners in which the pods, the connectors and the rods of the system of the present invention can be combined.
Figure 9B:
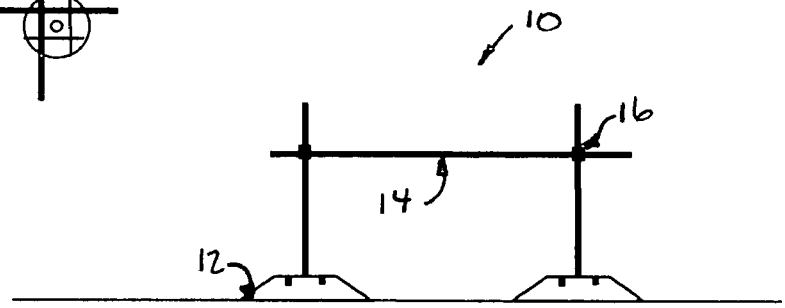

The first and second retaining assemblies are positioned such that when two stakes are coupled to the retaining assembly (one by each retaining assembly), the stakes are perpendicular to each other. One such configuration is shown in FIG. 9*b*. Advantageously, the retaining assemblies can be slid along the respective rod members such that repositioning of a connector relative to a stake can be quickly and easily accomplished. Of course, inasmuch as the rods can be provided in differing diameters, a multitude of different connectors may be provided of differing sized retaining members. In certain embodiments, the first and second retaining assemblies can be rotated relative to each other so as to change the angle at which the respective stakes intersect. In other embodiments, the first and second retaining members can be separated from each other.

Figure 10:
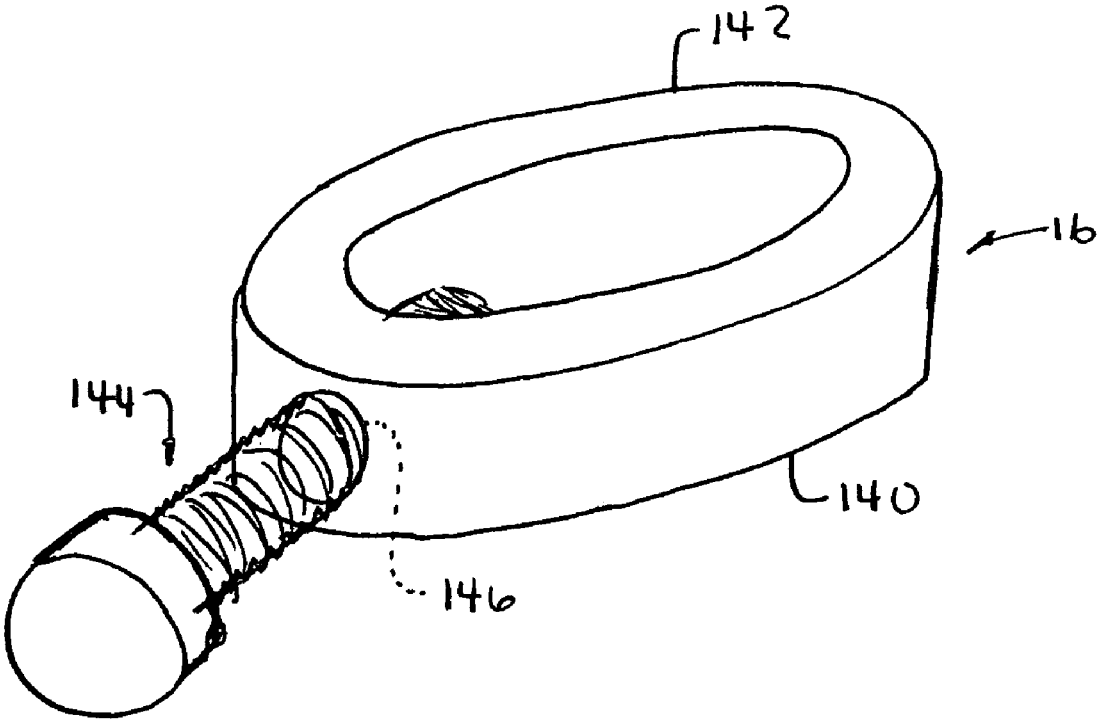
FIG. 10 of the drawings comprises a perspective view of an alternate connector of the system of the present invention.

With reference to FIG. 10, in another embodiment, connectors 16 comprise stake coupling members 140 and stake suspending members 144. Stake coupling members 140 each comprise ring member 142 and threaded opening 146. The ring member has an internal diameter larger than stakes 114. The threaded opening extends perpendicularly through the ring member and into the inner diameter of the ring member. As such, once the ring member is placed onto a stake, the suspending member can be threaded through the threaded opening and tightened so as to clamp the stake between a portion of the ring member and the stake suspending member.

Advantageously, a portion of the suspending member remains on the outside of the ring member. The suspending member is capable of receiving and suspending a rod member. For example, a suspending member can be coupled to each of two spaced apart stakes which are coupled to an opening of two respective pods. Once coupled, a further stake can be suspended from each of the stake suspending members 144. The height of the coupling members can be varied to adjust the height of the suspended stake.

Of course, other connectors are likewise contemplated wherein a connector is capable of releasably attaching two different stakes to each other wherein the stakes intersect each other at an oblique angle.

Figure 9C:
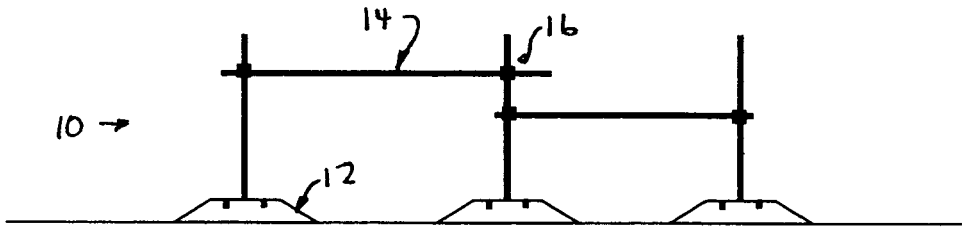
Figure 9D:
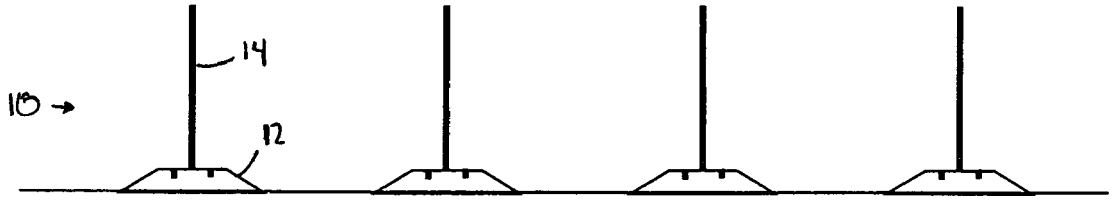

In operation, a user is capable of utilizing the apparatus for a number of different exercises. The rod members may be laid into any one of the channels of the pod. Additionally, stakes may be extended into the openings on the pods. Furthermore, through the use of connectors, stakes may be attached to other stakes. FIGS. 9*a* through 9*d* show merely a few of the countless combinations. For example, FIG. 9*a* shows a plurality of adjoining squares which are formed from a plurality of stakes and rods, wherein a user is required to run through the squares, placing one foot in each of the created squares. FIG. 9*b* shows two pods with a stake extending through the opening in each. A stake is extended between the opposing stakes and attached thereto through the connectors. FIG. 9*c* shows a plurality of pods each having a stake extending therethrough and a stake (or stakes) extending across a plurality of the vertical stakes creating a plurality of openings through which a ball can be directed. Such an aid facilitates improved ball handling skills in soccer by requiring users to direct a ball sequentially through each of the created openings. FIG. 9*d* shows a plurality of pods each having a stake extending vertically into the opening thereof. The pods are spaced apart from each other and create a slalom course through which a user must dribble a ball. Again, the foregoing are merely examples of what configurations are possible.

The foregoing description merely explains and illustrates the invention and the invention is not limited thereto except insofar as the appended claims are so limited, as those skilled in the art who have the disclosure before them will be able to make modifications without departing the scope of the invention.

What is claimed is:

1. A sporting activity system comprising:

a plurality of stakes, each having a length and a cross-sectional configuration; and a plurality of pods, each pod comprising:

a body having:

a lower edge adapted to position on an outside surface;

a side extending from the lower edge; and a top surface terminating the side, wherein the top surface is substantially planar;

means for interfacing with at least one stake of the plurality of stakes, the interfacing means comprising:

an opening disposed on the top surface and substantially co-planer therewith, the opening configured to receive a stake of the plurality of stakes that extends through the opening away substantially vertically from the top surface; and two pairs of channels set into the top surface and extending substantially horizontally and substantially perpendicular to an axis of the opening, the first pair extending substantially parallel to each other and on opposite sides of the opening, and having a raised area therebetween, the second pair extending substantially parallel to each other and on opposite sides of the opening, and having a raised area therebetween, wherein the first pair and the second pair are substantially orthogonal to each other, to define a double cross configuration, centered about the opening disposed on the top surface, each of the two pairs of channels spaced apart from the opening disposed on the top surface so that there is no intersection between the two pairs of channels and the opening, to, in turn, enable any of the two pairs of channels and the opening to accept a stake of the plurality of stakes simultaneously.

2. The sporting activity system of claim 1 further comprising at least one connector for associating a first stake to a second stake spaced apart from any one of the plurality of pods.

3. The sporting activity system of claim 2 wherein the at least one connector has a first stake retaining assembly and a second stake retaining assembly.

4. The sporting activity system of claim 3 wherein the first and second stake retaining assemblies of the at least one connector are configured such that a stake inserted into the first stake retaining assembly and a stake inserted into the second stake retaining assembly will be substantially orthogonal to each other.

5. The sporting activity system of claim 2 wherein the at least one connector includes a ring member and a threaded suspending member, the threaded suspending member threadable into a threaded opening in the ring member, wherein the threaded suspending member in cooperation with the ring member retains a stake therebetween, and a second stake member is suspended about the threaded suspending member outside of the ring member.

6. The sporting activity system of claim 1 wherein the two pairs of channels each include a longitudinal axis, the longitudinal axes intersecting with each other.

7. The sporting activity system of claim 1 wherein the body of the plurality of pods comprises a frustoconical configuration, with the opening extending through the center of the top surface.

8. The sporting activity system of claim 7 wherein the opening includes a skirt member depending from the top surface of the body, a portion of the skirt member has a region of a relatively reduced diameter.

9. The sporting activity system of claim 1 wherein the two pairs of channels each have a depth that is greater than the diameter of the at least one of the plurality of stakes.

10. The sporting activity system of claim 1 wherein a plane is defined by the lower edge of the body and longitudinal axes are defined by the two pairs of channels, the longitudinal axes of the two pairs of channels are each substantially parallel to the plane defined by the lower edge of the body.

11. The sporting activity system of claim 10 wherein the top surface of the body is substantially parallel to the lower edge of the body.

12. A pod for use in association with a sporting activity system, the pod comprising:

a body having:

a lower edge adapted to position on an outside surface;

a side extending from the lower edge; and a top surface terminating the side, wherein the top surface is substantially planar;

means for interfacing with at least one stake, the interfacing means comprising:

an opening disposed on the top surface and substantially co-planer therewith, the opening configured to receive the at least one stake that extends through the opening away substantially vertically from the top surface; and two pairs of channels set into the top surface and extending substantially horizontally and substantially perpendicular to an axis of the opening, the first pair extending substantially parallel to each other and on opposite sides of the opening, and having a raised area therebetween, the second pair extending substantially parallel to each other and on opposite sides of the opening, and having a raised area therebetween, wherein the first pair and the second pair are substantially orthogonal to each other, to define a double cross configuration, centered about the opening disposed on the top surface, each of the two pairs of channels spaced apart from the opening disposed on the top surface so that there is no intersection between the two fairs of channels and the opening, to, in turn, enable any of the two pairs of channels and the opening to accept a stake of the plurality of stakes simultaneously.

13. The sporting activity system of claim 12 wherein the body of the plurality of pods comprises a frustoconical configuration, with the opening extending through the center of the top surface.

14. The sporting activity system of claim 13 wherein the opening includes a skirt member depending from the top surface of the body, a portion of the skirt having a region of a relatively reduced diameter.

15. The sporting activity system of claim 12 wherein a plane is defined by the lower edge of the body and longitudinal axes are defined by the two pairs of channels, the longitudinal axes each being substantially parallel to the plane defined by the lower edge of the body.

* * * * *